US005120117A

United States Patent [19]

Williams

[11] Patent Number: 5,120,117

[45] Date of Patent: Jun. 9, 1992

[54] COMPUTER SUPPORT PLATFORM

[76] Inventor: Chauncey L. Williams, Rte. 3, Box 3964, Rio Piedras, P.R. 00928

[21] Appl. No.: 705,579

[22] Filed: May 24, 1991

[51] Int. Cl.[5] ..... H47B 27/00

[52] U.S. Cl. ..... 312/208; 248/918; 108/25

[58] Field of Search ..... 312/194, 196, 208, 242; 248/917, 918; 108/25, 26

[56] References Cited

U.S. PATENT DOCUMENTS

| | | | |
|---|---|---|---|
| 1,143,443 | 6/1915 | Schramm | 108/26 |
| 3,437,057 | 4/1969 | Wulff | 312/242 X |
| 4,145,097 | 3/1979 | Naess et al. . | |
| 4,345,803 | 8/1982 | Heck . | |
| 4,562,482 | 12/1985 | Brown . | |
| 4,590,866 | 5/1986 | Schairbaum . | |
| 4,635,893 | 1/1987 | Nelson | 248/918 X |
| 4,668,026 | 5/1987 | Lapeyre et al. . | |
| 4,669,789 | 6/1987 | Penberton . | |
| 4,735,467 | 4/1988 | Wolters . | |
| 4,755,009 | 7/1988 | Price . | |
| 4,766,422 | 8/1988 | Wolters et al. . | |
| 5,072,905 | 12/1991 | Hyatt | 248/918 X |

OTHER PUBLICATIONS

Global Computer Furniture Catalog CAT-K17, Oct., 1987.

Ultimate Computer Supplies Catalog, Oct., 1987.

*Primary Examiner*—Joseph Falk

*Attorney, Agent, or Firm*—Olive & Olive

[57] ABSTRACT

The invention relates to a preformed platform for assembly into a cutout section of a work table or counter to support a computer keyboard and monitor according to accepted ergonomic principles. The base of the keyboard is supported at a level below the ordinary desk height so as to allow typing to be done with the wrists substantially level and straight. A wrist support bar is provided to support the wrists and reduce wrist strain. The monitor and the keyboard are positioned with their operative centers at similar heights from the floor and at similar distances from the operator for optimum operator comfort and efficiency.

18 Claims, 4 Drawing Sheets

COMPUTER SUPPORT PLATFORM

BACKGROUND OF THE INVENTION

1. Field of Invention

This invention relates to the field of office furniture, and more particularly to an adaptation of a work surface for use with computer terminals.

2. Background of the Invention

The computer, particularly the personal, or minicomputer, has been one of the more significant and rapidly proliferating developments of modern science. It has become an indispensable business and science tool, used by every level of worker from data entry clerks to general managers and corporate presidents.

Along with the development and growth of the computer, numerous accessory devices have been created to enhance its effectiveness and to make the working environment of the computer operator more pleasant and efficient. However, along with all the benefits attached to the computer, there have been persistent problems. A primary problem which has been closely associated with the use of the computer is that of carpal tunnel syndrome.

Carpal tunnel syndrome is a debilitating injury to the wrist joint which has been frequently attributed to long term repetitive hand motion activities. Carpal tunnel syndrome affected typists long before the advent of the computer, and it has also affected people doing production circuit board assembly jobs, hand packing work, and so on. Because such a large number of contemporary workers use computers for long hours, carpal tunnel syndrome has seemed to become more prevalent. A further factor contributing to carpal tunnel syndrome and its symptoms is the strain on the operator's wrists due to using a keyboard that is too high or too low.

The median nerve and flexor tendons of each hand pass through a small opening in the wrist known as the carpal tunnel. When continuous activities involving strain on the wrist are combined with finger articulation, swelling in the carpal area may occur which, in turn, creates pressure on the median nerve. The resultant pain, tingling and numbness of the fingers are the symptoms typical of carpal tunnel syndrome. Medical treatment involves either immobilization of the wrist for a period of several weeks or surgery to relieve the pressure. If the activity of repetitive wrist and hand motions is subsequently resumed, the likelihood of a recurrence is great.

Another problem related to the use of a computer terminal, is that of neck and back strain. This problem is created by continuously sitting in a difficult position due to the location of the monitor, the keyboard, or both in relation to the position of the operator's chair. If the monitor is at a distance so that it cannot be easily read or is far off center, the operator may sit in an uncomfortable position for long periods at a time. If the keyboard is too far from the operator's seat or at the wrong height, a similar discomfort may occur. The height and location of the keyboard as it relates to wrist articulation and position also impacts directly on the potential for carpal tunnel syndrome, discussed above.

While the operator of the computer is working, it is frequently necessary to look from the keyboard to the monitor screen and back again to perform various tasks. If these equipment components are not located in advantageous positions, this activity could cause strain to the muscles of the neck and of the eyes. It is ergonomically preferable but not previously achieved to have the keyboard and the monitor screen located somewhat close to each other and at about equal height and visually comfortable distances from the eye of the user. In that way the head movements and eye focus adjustments will be minimized thereby improving efficiency and reducing physical stress.

If these factors of keyboard and monitor screen positioning are not right, a further difficulty may be experienced by computer operators who wear corrective glasses. By encountering a working space in which the monitor screen and the keyboard are not at comfortable distances, the ability of these operators to correctly read and type the information correctly will be compromised. In addition, they are likely to suffer the effects of eye strain.

Most chairs used in the modern office environment have substantial adjustability. These chairs swivel and roll, adjust for height and sometimes tilt. The usual practice is to adjust the chair to the comfort of the operator. Once this has been accomplished, consideration must be given to the height of the keyboard relative to the level position of the operator's wrists and the height and location of the monitor screen.

There have been many attempts to create the ideal workstation in the field of computer accessories and furniture. Among the issued patents for such devices is U.S. Pat. No. 4,385,803 to Peter J. Heck. This patent discloses a specialized desk/workstation for use by a computer operator. The desk has a lower level for a keyboard and an upper level for a monitor with side platforms for papers or other work equipment. The Heck patent teaching recognizes the need for a keyboard at a level lower than the conventional desk height for comfort and fatigue minimization, but does not deal adequately with the positioning of the monitor screen and only addresses the fatigue factor of the wrists and ignores the possibility of carpal tunnel syndrome entirely. Using this teaching requires the purchase of a special piece of furniture, rather than the adaptation of existing or standard furniture.

U.S. Pat. No. 4,766,422 to Wolters et al. and U.S. Pat. No. 4,669,789 to Peter F. Pemberton focus on creating a computer workstation that physically converts by various mechanisms into an ordinary desk and hides the computer hardware within. These inventions are useful for the occasional computer user but are not particularly practical for the frequent user.

Public recognition of these and other factors affecting the organization of the computer workstation has occurred in the recent promulgation of the San Francisco Video Display Terminal Worker Safety Ordinance of Dec. 10, 1990. This recent law attempts to correct problems of operator fatigue and injury by chair adjustments and computer terminal component placement.

Therefore, it is an object of the present invention to create a computer workstation which optimizes the positioning of the keyboard and the monitor for the comfort and efficiency of the user.

It is a further object of the invention to reduce the tendency toward wrist strain and carpal tunnel syndrome.

It is an additional object of the present invention to reduce eye, neck and back strain through the ergonomic locating of the keyboard and monitor screen.

An additional object of the invention is to create a preformed workstation which may be installed by modifying an existing desk, table or counter.

These and further objects and benefits of the present invention will become apparent as the details are disclosed herein.

SUMMARY OF THE INVENTION

The present invention provides a preformed platform for the support of the keyboard and monitor components of a computer terminal. The preformed platform is formed such that it can be mounted into an opening shaped to accommodate the platform and which is cut in an existing table or countertop. The platform comprises two major sections, one to hold the keyboard referred to as the keyboard section, and the other to hold the monitor referred to as the monitor section. The two sections are situated relative to one another so as to allow location of the keyboard and the monitor screen near each other and with their operative centers at substantially equal heights and at visually comfortable distances from the eye of the operator. The keyboard section is arranged to be at a level lower than the table or countertop height so as to permit the computer operator to maintain level, straight wrists. In addition to the level positioning of the wrist-to-keyboard relationship, a wrist supporting bar is provided to keep wrist strain to a minimum.

The computer monitor is mounted in the monitor section of the platform such that the monitor screen is directed at the head of the user. To locate the center of the monitor screen at approximately the same height as the operating portion of the keyboard base, an aperture in the platform is adapted to accept and support the body of the monitor. As supported in this aperture, the monitor screen is pointed angularly upward and laterally inward to be easily read by the operator.

The entire computer support platform of the invention as summarily described above is adapted to be mounted in a cutout section of a table or a countertop, and frequently allows the use of existing furniture or equipment. These platforms are adapted to be used individually or arranged in groups to optimize the utilization of space in the office environment.

DESCRIPTION OF PREFERRED EMBODIMENT

According to the objects of the present invention, a preformed platform is disclosed which is adapted to be inserted into a cutout portion of a work surface and to optimally position and support the main operating components of a computer terminal in conformance with accepted ergonomic principles.

The computer support platform 10 may be made of a number of assembled components or of a single sheet of material. In the preferred embodiment, the platform is a single piece of plastic sheet material which is thermoformed to the appropriate configuration. Any plastic capable of being formed when warm by the application of pressure or vacuum into a specific shape could be utilized. The selected material must have sufficient structural rigidity to support the equipment weight, sustain the impact of typing, and withstand the stress of having the wrists of the user resting thereupon. A plastic material having the requisite characteristics is acrylonitrile butadiene styrene (ABS) which is available from a variety of sources. An appropriate sheet thickness for this application is one-fourth ($\frac{1}{4}$) inch.

Figure 5:
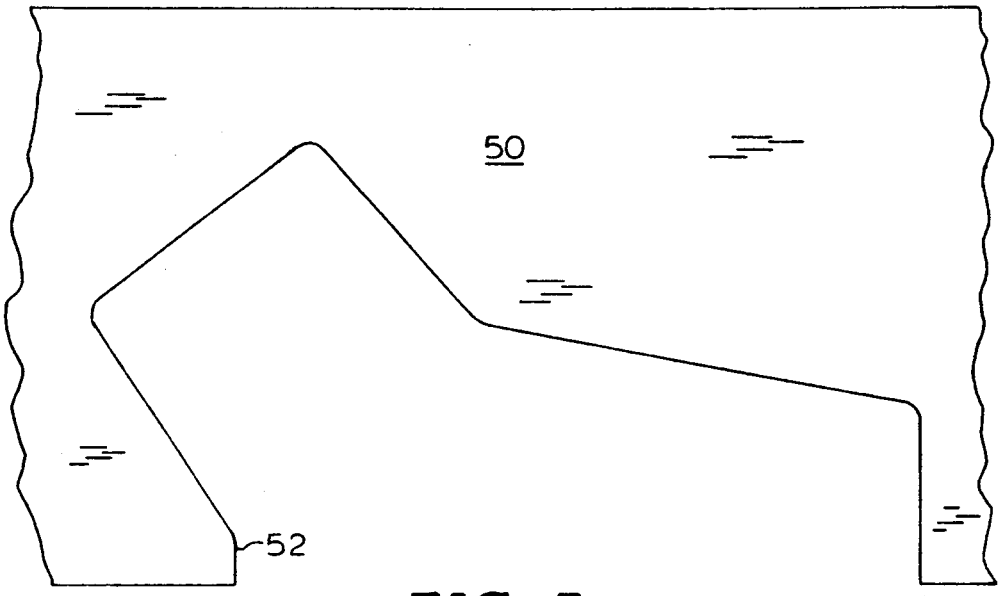
FIG. 5 is a plan view of a section of a work table cut out with an appropriate contour to accept the computer support platform of the invention.

FIG. 5 is a plan view of a section of a typical office work table or counter area 50 which has been prepared for receiving of the computer support platform 10 by cutting out a section thereof. The contour of the cut 52 is such that the resulting opening will receive the computer support platform 10 with portions of the platform resting upon the table surface 50 and other portions being dropped below the surface 50 into the cutout opening.

Figure 1:
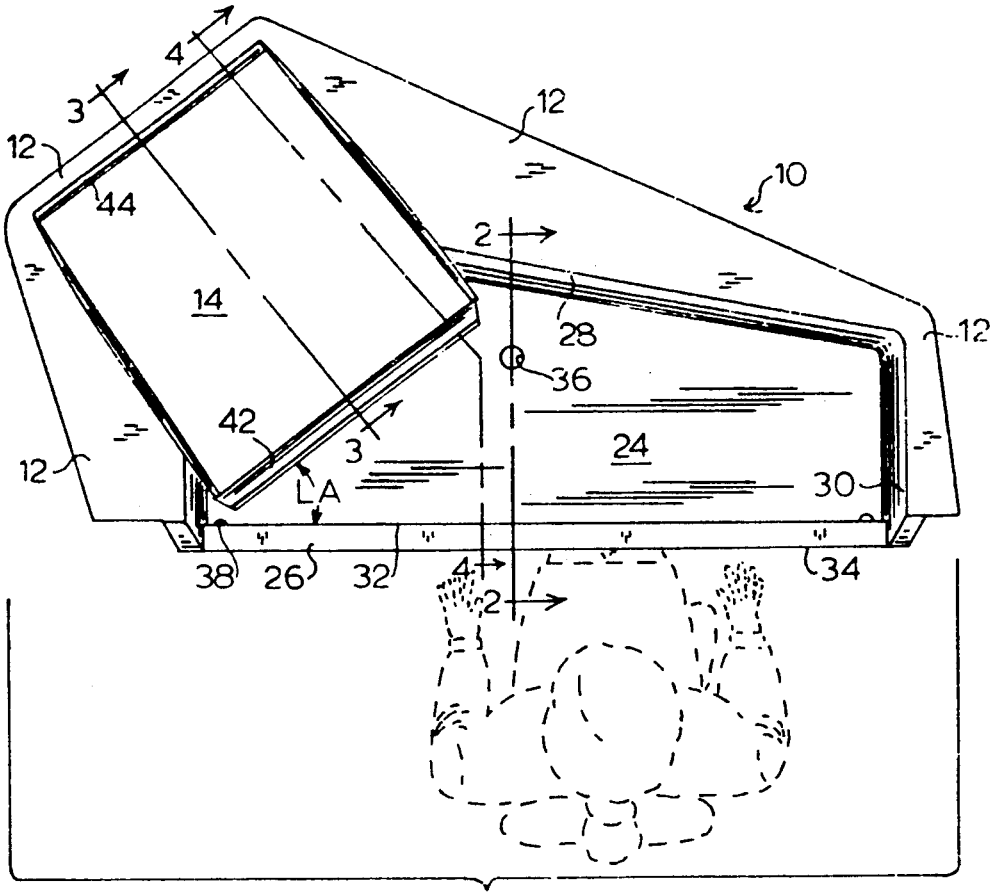
FIG. 1 is a top plan view of the computer support platform of the invention without the monitor and keyboard installed and illustrating in dashed lines the computer operator seated adjacent to the platform.

Referring next to FIG. 1, the overall shape of computer support platform 10 is adapted to positioning the computer components according to the desired arrangement. In this plan view the operator is illustrated to be at a position in front of the platform 10 to operate the computer equipment. Planar flange 12 is adapted to rest upon the worktable surface (not shown). Planar, horizontal keyboard support platform 24 is positioned closest to the operator position and parallel to flange 12 and is surrounded on three sides with substantially vertically upwardly directed walls 28, 30, 32. Within keyboard platform 24 is aperture 36 which is of a size and location to conveniently pass a connecting cable from the keyboard to the underside of the platform 10 and there to connect to the monitor. It is also seen that the distance from the center of the monitor screen portion to the eye of the operator and the distance from the center of the keyboard portion to the eye of the operator are visually comfortable.

A comparison of the table cutout contour 52 depicted in FIG. 5 and the computer support platform 10 of the present invention as shown in FIG. 1 clearly shows the relationship of the two parts. As it is illustrated, keyboard platform 24 and monitor opening 14 (described below) are positioned to be placed through the cutout 52 in table 50 such that the platform 24 and monitor support brackets 42, 44 will reside below the level of the table surface 50. Peripheral flange 12 commences at the operator side of the computer support platform 10 on the left and continues around the portion opposite the operator and terminates at the right section close to the operator, thus deriving a stable support for the unit as mounted into the table cutout. After being mounted, the platform 10 may be attached to the table surface 50 in any convenient manner.

Figure 2:
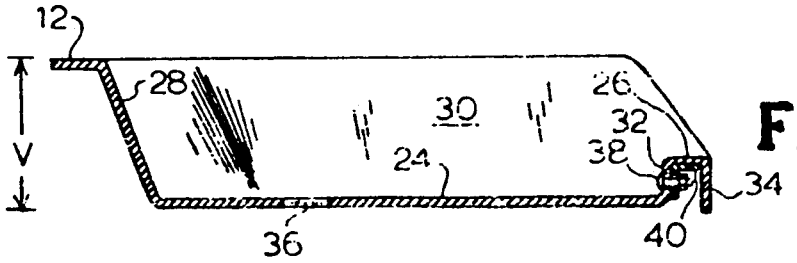
FIG. 2 is a sectional elevation view of the keyboard platform taken in the direction of line 2—2 of FIG. 1.

As further illustrated in FIG. 1, the wall 32 which is closest to the operator position joins wrist support bar 26 which, in turn, joins vertical outer wall 34. Greater detail of this configuration is seen in FIG. 2.

Figure 4:
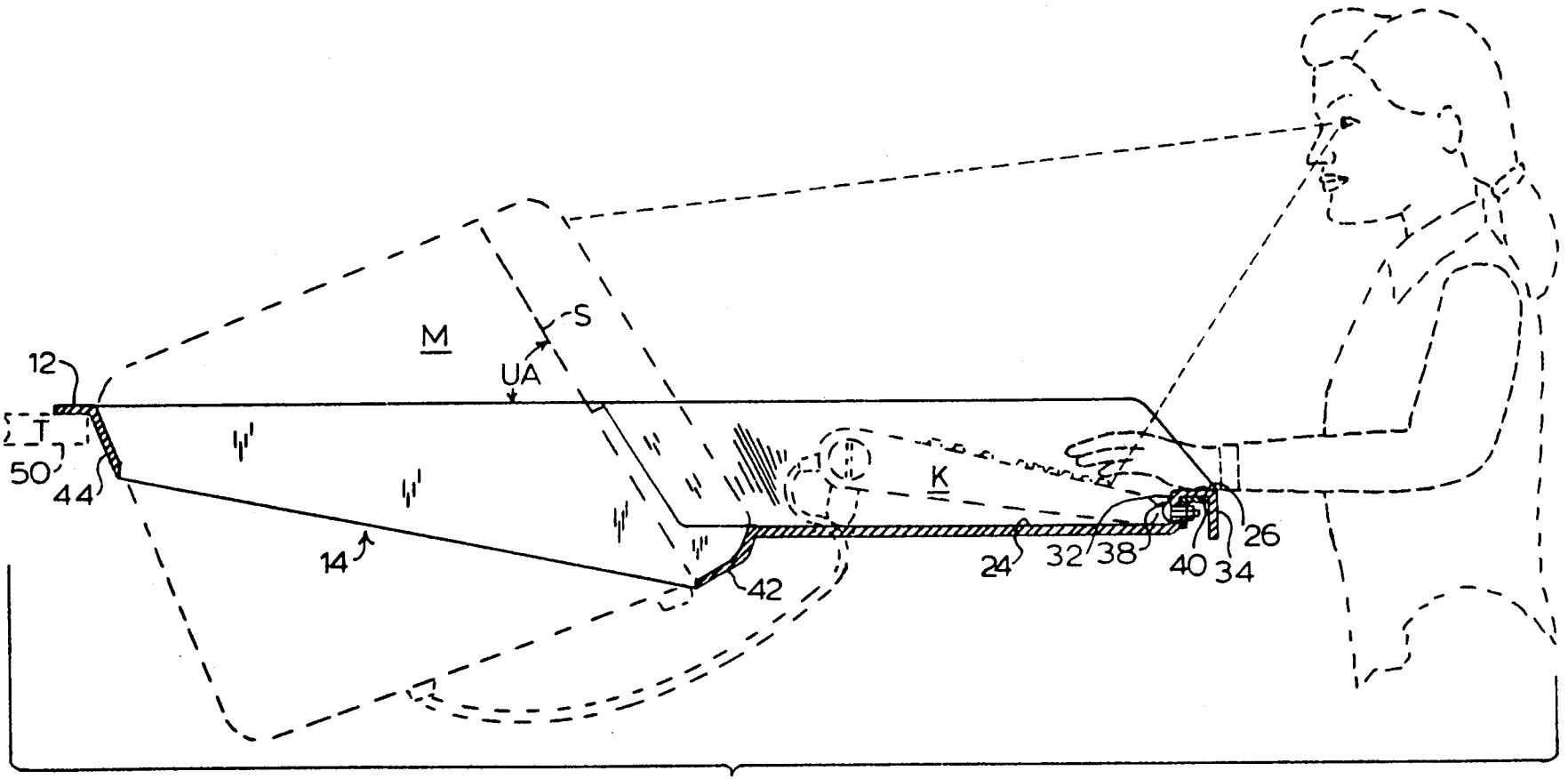
FIG. 4 an angular cut sectional elevation view taken in the direction of line 4—4 of FIG. 1, showing the keyboard and the monitor in dashed lines mounted on the computer support platform of the present invention.

At the side of and somewhat behind keyboard platform 24 is rectangular aperture 14 which is adapted to partially pass and support the body of the monitor on front and rear brackets 42, 44. The monitor is placed into aperture 14 in angular orientation to rest and be supported partly into aperture 14. The rear upper corner of the monitor rests against rear monitor bracket 44 and the front lower corner of the monitor rests upon front monitor bracket 42 as shown in FIG. 4.

Due to the relative positioning of the keyboard section and the monitor section of the computer support platform, the total distance from wrist support bar 26 to the rear portion of support flange 12 is reduced; i.e. in comparison to the distance required when the monitor is placed directly behind the keyboard as is frequently done. In this way, it is possible to use a narrower worktable with a computer when installing the platform of the present invention.

The particular description contained in the preferred embodiment and used by way of example relates to a platform adapted to support a Model 30 PC Computer made by International Business Machines. However, it is to be recognized that the principles and concepts covered pertain to a broad range of computers and modifications of size and shape are considered within the scope and intent of this disclosure.

The keyboard platform 24 is shown in sectional elevation view and in greater detail in FIG. 2. At the portion of the computer support platform 10 closest to the operator (right section of drawing) the keyboard platform 24 is bordered by an upwardly directed wall 32 which joins into horizontal, outwardly directed wrist support bar 26 and then to vertical downwardly directed border wall 34. These two walls 32, 34 and wrist support bar 26 span the large open space of the table cutout 52, therefore subjecting this segment to possible flex stress as the weight of the equipment and operation is applied to the top side thereof. To overcome the potential for deflection to a significant extent, a reinforcing member 40 is added beneath the channel-like structure. As illustrated, the reinforcement comprises a metal angle brace 40 which is assembled beneath the channel-like structure of the wrist support bar 26 and is secured with a series of bolts and nuts 38. Other means of reinforcement, including molded integral ribs may be substituted depending upon the design requirements and methods of manufacture used.

In the portion of the keyboard platform 24 approximately at the rear of the keyboard to be placed thereupon, a cable passage hole 36 is provided to allow the passing of the connecting cable from the keyboard to the monitor. At the rear of keyboard platform 24 is wall 28 at a slight angle to the vertical and which connects the keyboard platform 24 to support flange 12. The overall result is that the vertical distance, for the example being used, between horizontal support flange 12 and horizontal keyboard platform 24 labelled V is optimally three (3) inches. This lowers the keyboard platform 24 from the work table height of a standard 29½ inches to an accepted typing platform height of 26½ inches above the floor. This height coupled with wrist support bar 26 positions the wrists of the average operator seated in a properly adjusted chair approximately level and straight, thus reducing the possibility of wrist strain and carpal tunnel syndrome.

Figure 3:
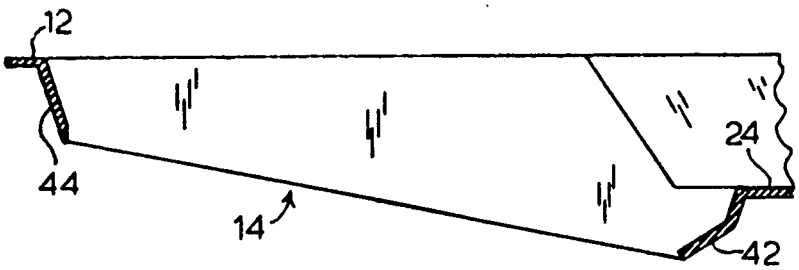
FIG. 3 sectional elevation view of the monitor support aperture taken in the direction of line 3—3 of FIG. 1.

A side elevation view as shown in FIG. 3 portrays the aperture 14 for positioning the monitor. By providing aperture 14 between keyboard platform 24 and support flange 12, the monitor brackets 42, 44 formed at front and rear borders of aperture 14 hold and angularly position the monitor such that its screen is in an optimum position for operator vision and strain minimization. FIG. 1 illustrates the angle of the monitor as placed in aperture 14 such that a line drawn perpendicular to the plane of the monitor screen and through its center would be directed at the head of the operator. A monitor front bracket 42, integrally molded into the platform 10 is positioned in front of and below the corner of the monitor. A monitor rear bracket 44 similarly molded into the computer support platform 10, prevents the rear of the monitor from falling or moving rearward. The size, position and angle of the brackets 42, 44 are such as to accommodate the particular monitor used.

Figure 7:
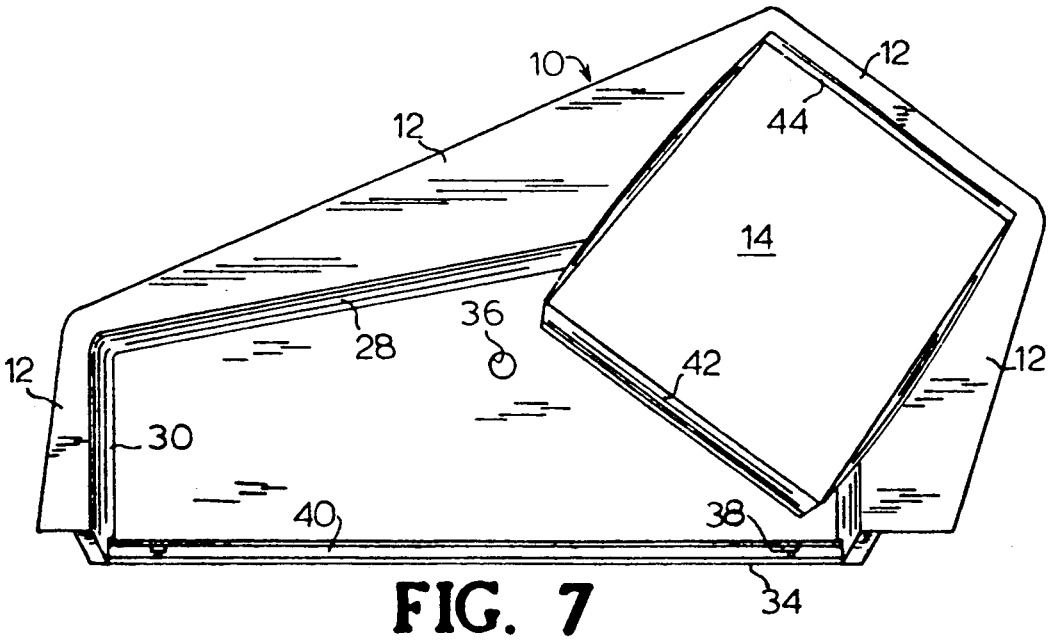
FIG. 7 is a bottom plan view of the computer support platform of the invention.

FIG. 7 is the reverse of FIG. 1, showing the bottom side in plan view of computer support platform 10. As seen from below, planar flange 12 surrounds three sides of platform 10, rectangular monitor aperture 14 is formed to the side and rear and has monitor front and rear brackets 42, 44 respectively. Reinforcing angle bracket 40 is shown passing along the underside of wrist support bar and held in place by bolts and nuts 38.

A further factor affecting the relationship of the operator and the computer equipment is the height and distance of the chair. As most modern office chairs are adjustable for height and may be moved around the floor area, it is assumed that the operator will adjust and place the chair to his or her own comfort.

FIG. 4 portrays the combined relationships of keyboard platform 24, monitor support aperture 14 and the work table 50 in a single view including the computer components. Since the section for FIG. 4 is taken along two intersecting lines, the relative distance from the monitor screen S to the operator is exaggerated. The optimum positioning of the keyboard K and the monitor M, with the keyboard K placed behind and its base positioned slightly lower than the wrist support bar 26 and with the monitor screen S angled upwardly towards the eye of the operator slightly behind the keyboard K, is therefore accomplished. Here the ergonomic design factor placing the height of the operator's monitor screen and the height of the keyboard within the operator's field of vision, allows the operator to look from one component to the other with only minor head and eye movement. FIG. 4 also illustrates the upwardly directed angle of the monitor as placed in aperture 14 such that a line drawn perpendicular to the plane of and through the center of the monitor screen would also be directed at the head of the operator. The result of this compound angle (lateral angle LA of FIG. 1 plus upward angle UA of FIG. 4) facing the operator is to reduce considerably the amount of head and eye movement required while workinq at the terminal. Thus, strain and fatigue are effectively reduced. Also, the novel feature of supporting the wrists of the operator on wrist support bar 26 which is located at a height such that typing may be done with wrists substantially straight and level will help minimize the possibility of carpal tunnel syndrome. The support of the computer support platform by means of support flange 12 resting on table 50 within the cut out portion is shown at the rear portion furthest from the operator.

Figure 6:
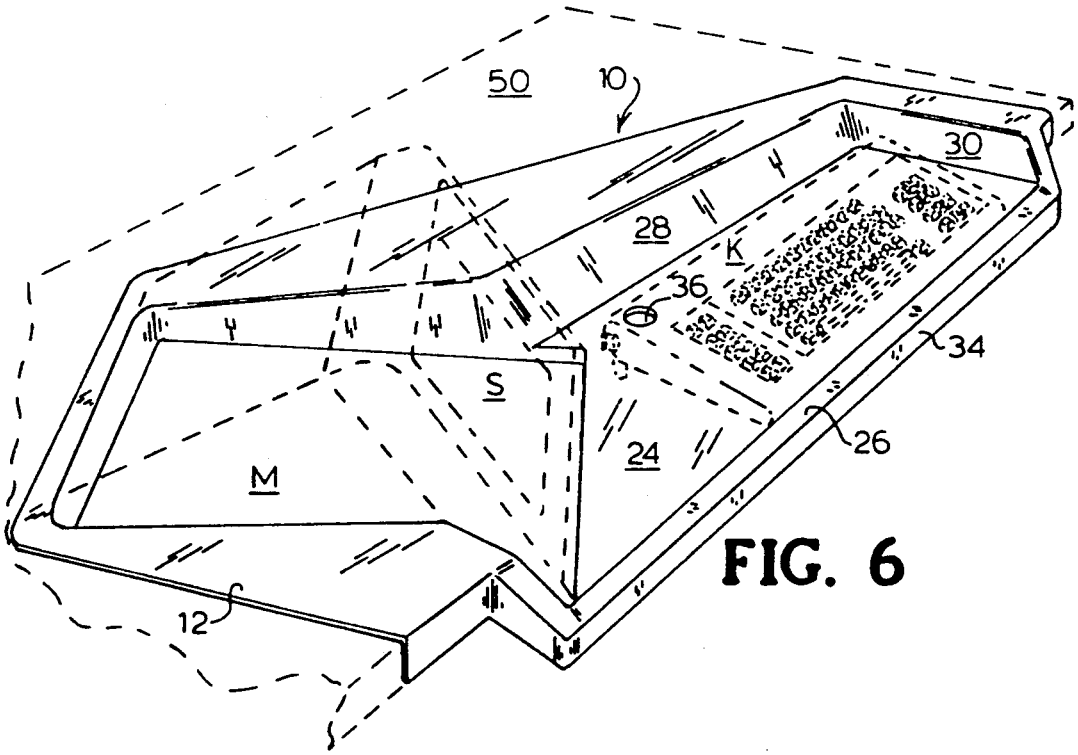
FIG. 6 is a perspective view of the computer support platform of the invention as mounted into a prepared work table shown in dashed lines with the platform supporting a keyboard and monitor of a typical computer shown in dashed lines.

A composite view of the entire invention with the computer components supported on the designated surfaces may be seen in perspective view in FIG. 6. Work table 50 is shown cut out to accommodate the computer support platform 10 of the invention which rests on table 50 by means of support flange 12. Front wall 34 and wrist bar 26 form the forward border of the platform slightly in front of the keyboard K on the keyboard platform 24. Keyboard platform 24 is sized larger than keyboard K so the operator may move the keyboard K into a most effective position. The monitor M is placed into aperture 14 to enable its screen to be at an angle essentially directed at the eye of the operator, that location being both comfortable and best for accurately reading displayed data. The connecting cable from the keyboard passes through hole 36 in platform 24 to connect to the monitor and be out of sight.

Through drawings and descriptive disclosure of the preferred embodiment of the invention, a particular example of one of the possible forms which the invention may take has been portrayed. This example is not in any way to be considered a limitation on the scope and magnitude of the invention, but merely as a particular form thereof.

I claim:

1. A preformed platform fittable to a work surface for supporting a computer having a monitor with a screen and a keyboard with keys on a base, comprising:

(a) a support member formed with a monitor support section adapted to support a monitor in a tilted position for optimal viewing of its screen and a keyboard support section for supporting the base of the keyboard substantially horizontally and below the plane of the work surface for optimal use of its keys while viewing said screen;

(b) said support member being adapted to fit into a mating opening formed in a table top or like work surface;

(c) means for supporting said support member while fitted in said opening;

(d) said keyboard support section being formed with means for supporting said keyboard at a height and in a position such that the wrists of the operator of said computer can assume a substantially straight and level position; and (e) said monitor support section being formed with an opening for receiving said monitor therein and with integral support means located to support the monitor in said tilted position suitable for viewing and coordinated with the level and position of said keyboard to minimize physical strain on the operator of the computer.

2. A preformed platform as claimed in claim 1 wherein said molded support member is formed of a unitary molded single piece of plastic material.

3. A preformed platform as claimed in claim 1, including:

(a) means for supporting said support member while fitted in said opening; and (b) said keyboard support section being formed with means for supporting said keyboard at a height and in a position such that the wrists of the operator of said computer can assume a substantially straight and level position.

4. A preformed platform as claimed in claim 1 wherein said monitor support section as viewed from above said work surface is located to the side and extends rearwardly of said keyboard support section.

5. A preformed platform as claimed in claim 1 wherein said means for supporting said support member comprises a flange formed integral with said support member and adapted to rest on said work surface.

6. A preformed platform fittable to a work surface for supporting a computer having a monitor with a screen and a keyboard with keys on a base, comprising:

(a) a support member formed with a monitor support section adapted to support a monitor in a tilted position for optimal viewing of its screen and a keyboard support section for supporting the base of the keyboard substantially horizontally and below the plane of the work surface for optimal use of its keys while viewing said screen;

(b) said support member being adapted to fit into a mating opening formed in a table top or like work surface;

(c) means for supporting said support member while fitted in said opening;

(d) said monitor support section being formed with an opening for receiving said monitor therien and with integral support means located to support the monitor in said tilted position suitable for viewing and coordinated with the level and position of said keyboard to minimize physical strain on the operator of the computer.

7. A preformed platform as claimed in claim 5 wherein said means for supporting said support member comprises a flange formed integral with said support member and adapted to rest on said work surface.

8. A preformed platform as claimed in claim 6 wherein said molded support member is formed of a unitary molded piece of plastic material.

9. A preformed platform as claimed in claim 6 wherein said monitor support section as viewed from above said work surface is located to the side and extends rearwardly of said keyboard support section.

10. A preformed platform as claimed in claim 9 wherein said molded support member is formed of a unitary molded piece of plastic material.

11. A computer support platform adapted to mount within a mating opening in a work surface to support a computer having a keyboard with keys and a monitor with a screen, comprising:

(a) a keyboard support section formed to support a computer keyboard substantially horizontal and below the plane of the work surface and at a height such that the wrists of the operator can be substantially straight and level when using said computer keyboard;

(b) a monitor support section formed with an opening and integral support means adapted to receive and to support a computer monitor such that the center of its screen is positioned at a height approximately equal to the height of the keyboard and such that the screen of said monitor is angled and directed approximately at the eyes of the operator coordinated with the position and level of the keyboard; and (c) means on said keyboard section adapted to support the wrists of the operator when using the computer keyboard in a substantially straight and level position.

12. A computer support platform adapted to mount on a modified work surface to support a computer monitor having a screen and a computer keyboard having keys, comprising:

(a) a horizontal planar peripheral support flange;

(b) a keyboard platform parallel to said peripheral support flange and at a level lower than said flange and connected thereto by a plurality of upwardly directed walls, said keyboard platform having a front side and a rear side and being configured to mount a computer keyboard;

(c) a wrist support bar mounted parallel to said support flange and connected to the front side of said keyboard platform at a level above said keyboard platform to support the wrists of the user; and (d) a monitor mounting section having an aperture configured to accept a computer monitor and to angularly position the monitor so that its screen is directed at the head of the user, said monitor mounting section being connected to the rear side of said keyboard platform and having monitor support means, comprising:

(i) a front bottom corner monitor engaging bracket extending from said keyboard platform at a downwardly directed angle at a forward edge of said aperture; and (ii) a rear monitor top corner engaging bracket extending from said peripheral support flange at a downwardly directed angle at a rear edge of said aperture.

13. A computer support platform as claimed in claim 12 in which said keyboard platform and said monitor mounting section are arranged so as to locate the keys of the keyboard and the center of the monitor screen at approximately equal height and within the operator's field of vision.

14. A computer support platform as claimed in claim 12 in which said wrist support bar is structurally reinforced.

15. A computer support platform adapted to be assembled with a modified work surface to support a computer keyboard having keys and a computer monitor having a screen, comprising:

(a) a horizontal planar peripheral support flange;

(b) a keyboard platform arranged parallel to said peripheral support flange at a level lower than said flange and connected thereto by a plurality of upwardly directed walls, said keyboard platform being configured to mount said computer keyboard;

(c) a wrist support bar mounted parallel to said support flange and connected to a front side of said keyboard platform at a level above said keyboard platform to support the wrists of the user, said wrist support bar being structurally reinforced; and (d) a monitor mounting section having an aperture configured to accept said monitor and to angularly direct the screen of said monitor so that said screen is directed at the head of the user and said screen and keyboard are positioned within the operator's field of vision, said monitor mounting section being connected to a rear side of said keyboard platform and having monitor support means, comprising;

(i) a front monitor bottom corner engaging bracket extending from said keyboard platform at a forward edge of said aperture; and (ii) a rear monitor top corner engaging bracket extending from said peripheral support flange at a rear edge of said aperture.

16. A preformed platform as claimed in claim 12 wherein said molded support member is formed of a unitary molded piece of plastic material.

17. A preformed platform as claimed in claim 12 wherein said monitor support section as viewed from above said work surface is located to the side and extends rearwardly of said keyboard support section.

18. A preformed platform as claimed in claim 17 wherein said molded support member is formed of a unitary molded piece of plastic material.

* * * * *